US006634172B2

(12) United States Patent
Schoonmaker et al.

(10) Patent No.: US 6,634,172 B2
(45) Date of Patent: Oct. 21, 2003

(54) THERMAL CONTRACTION CONTROL APPARATUS FOR HYDRAULIC CYLINDERS

(75) Inventors: Stephen J. Schoonmaker, Chambersburg, PA (US); Jeffrey L. Addleman, Chambersburg, PA (US)

(73) Assignee: Grove U.S. LLC, Shady Grove, PA (US)

( * ) Notice: Subject to any disclaimer, the term of this patent is extended or adjusted under 35 U.S.C. 154(b) by 0 days.

(21) Appl. No.: 10/082,217

(22) Filed: Feb. 26, 2002

(65) Prior Publication Data

US 2003/0159576 A1 Aug. 28, 2003

(51) Int. Cl.[7] ..... F15B 15/20

(52) U.S. Cl. ..... 60/329; 60/399; 60/442; 91/361

(58) Field of Search ..... 60/329, 399, 403, 60/406, 432, 442, 451, 459; 91/20, 28, 361, 403

(56) References Cited

U.S. PATENT DOCUMENTS

| | | | | |
|---|---|---|---|---|
| 2,005,731 A | * | 6/1935 | Ernst et al. | 60/329 |
| 2,982,101 A | | 5/1961 | Hackett et al. | |
| 3,040,533 A | | 6/1962 | Heinrich et al. | |
| 3,425,574 A | | 2/1969 | Willgrubs et al. | |
| 3,702,057 A | | 11/1972 | Rabiger | |
| 3,871,266 A | | 3/1975 | Schwab et al. | |
| 4,484,443 A | | 11/1984 | Takigawa et al. | |
| 4,938,109 A | * | 7/1990 | Torres et al. | 81/467 |
| 5,154,207 A | | 10/1992 | Bolt | |
| 5,218,820 A | | 6/1993 | Sepehri et al. | |
| 5,244,004 A | | 9/1993 | Robertson | |
| 5,251,440 A | | 10/1993 | Bong-dong et al. | |
| 5,410,878 A | | 5/1995 | Lee et al. | |
| 5,666,806 A | * | 9/1997 | Dietz | 91/361 |
| 5,832,730 A | | 11/1998 | Mizui | |
| 5,943,860 A | | 8/1999 | Kato | |
| 6,195,989 B1 | | 3/2001 | Hall et al. | |

* cited by examiner

*Primary Examiner*—Edward K. Look
*Assistant Examiner*—Thomas E. Lazo
(74) *Attorney, Agent, or Firm*—Birch, Stewart, Kolasch & Birch, LLP

(57) ABSTRACT

A method and apparatus for operating a load lifting device to move a load and hold the load steady is disclosed. In the conventional arts, a lifted or lowered suspended load had a tendency to move from its desired position, as hydraulic fluid in the lifting system cooled, e.g. a stick slip condition. The present invention monitors a fluid pressure in the lifting system and compensates the fluid pressure to accommodate any pressure drop due to fluid cooling. Thereby, the load can be effectively held steady at a desired position, and the stick slip condition can be avoided.

20 Claims, 4 Drawing Sheets

THERMAL CONTRACTION CONTROL APPARATUS FOR HYDRAULIC CYLINDERS

BACKGROUND OF THE INVENTION

1. Field of the Invention

The present invention relates to a control system for a hydraulic cylinder. More particularly, the present invention relates to a control system which can stabilize a hydraulic cylinder under load.

2. Description of the Relevant Art

A hydraulic cylinder is often employed in a load lifting device, such as a crane. Fluid is supplied to, or removed from, the hydraulic cylinder to cause a piston to move within the hydraulic cylinder. Movement of the piston enables a boom of the load lifting device to lift or lower a load.

When the load is lifted, or lowered, to a desired height, an operator of the load lifting device deactivates a control to stop the fluid flow relative to the hydraulic cylinder. At this point, movement of the boom stops. Then, workers in the vicinity of the load remove, modify or otherwise interact with the load.

A natural phenomenon is known to occur once lifting or lowering of the load is stopped at the desired height. Specifically, the load will sometimes slightly lower, despite the fact that the operator has set the control to stop movement of the load. This phenomenon has been called a "stick slip condition" in the art.

The "stick slip condition" can be very concerning, particularly when workers are in the vicinity of the load. For example, a worker could be injured under the load, pinned between a shift in the load, or could lose their balance when the load moves.

The "stick slip condition" occurs because of a cooling of the hydraulic fluid. When fluid is repeatedly pumped into, and evacuated from, hydraulic components in the system, the temperature of the fluid in the cylinder will be raised significantly. Further, the temperature of the mechanical system handling the fluid will rise. Once the operator controls the load lifting device to stop movement of the load, fluid is no longer pumped into or evacuated from the hydraulic cylinder. As the fluid and mechanical system sit idle, they cool. This causes the pressure in the hydraulic cylinder to decrease. The pressure decreases because of a change in the energy of the fluid as it cools (i.e. a thermal fluid contraction), and a change in the static friction of the mechanical system as it cools.

Eventually, the pressure in the hydraulic cylinder will decrease to a point where the force on the piston in the cylinder, due to the load attached thereto, is greater than the system's static pressure in the hydraulic cylinder supporting the piston, plus the mechanical friction. When this occurs, the piston will move, and hence the load will slightly lower, until a new equilibrium inside the hydraulic cylinder is established. If the mechanical system static friction is large enough to support the load to a significant degree, then the piston motion that results from that static friction finally being overcome can be substantial and very sudden (i.e. the "stick slip condition"). This cycle may repeat itself numerous times as the fluid continues to cool.

Once the fluid cools to the environmental temperature, the lowering cycles of the load will stop and the "stick slip condition" will cease. However, in the typical operation of a crane, it would be undesirable to allow a load to remain at a desired height for the amount of time needed for the fluid to completely cool, and the possibility of a "stick slip condition" to pass. Such a practice would greatly increase the time and money required in typical construction projects. Therefore, there is a need in the art for a system which can effectively reduce or eliminate the occurrence of a "stick slip condition" immediately upon raising or lowering a load to a desired height.

A first solution in the background art has been to provide a pinning system. In the first solution, once the load is elevated or lowered to the desired height a physical pin is inserted through aligned holes in moveable sections of the boom to physically link the boom sections together. The weight of the load is essentially held by the pins. Hence, if the pressure in the hydraulic cylinder drops, the load will not lower.

The first solution has drawbacks. The cost and maintenance associated with a pinning system must be added to the boom. The pinning system itself adds weight to the boom. Further, the drilling of holes through the boom sections makes it necessary to enlarge the size of the boom sections in order to maintain a suitable strength for the boom sections Another drawback of the first solution is that only a finite number of holes are provided in the boom sections. Therefore, the load has to reside at one of only a few possible heights in order for the pins to pass through the aligned holes in the moveable boom sections. Often, the closest "lockable" height for the load is not the optimum, or even a desirable, height in a particular circumstance.

As an alternative to the pinning solution, a second solution has been proposed in the background art. In the second solution, hydraulic pressure is maintained on the piston or rod side of the hydraulic cylinder. This pressure acts to buffer or dampen any movement of the piston as the hydraulic fluid cools.

The second solution does not prevent the "stick slip condition," but rather smoothes the decent of the load as its lowers, by preventing a violent downward lurch in the load. The second solution reduces the likelihood that the load will shift, and may provide some additional time for a worker in the vicinity of the load to react by getting out of the way, or maintaining their balance when working around the load.

SUMMARY OF THE INVENTION

It is an object of the present invention to address one or more of the drawbacks associated with the background art.

Further, it is an object of the present invention to provide a method and system to prevent a "stick slip condition."

Further, it is an object of the present invention to provide a control system and method for operating a load lifting device which improves the safety and accuracy of its operation.

Further, it is an object of the present invention to provide a control system and method for operating a load lifting device which maintains a constant pressure in a hydraulic cylinder sufficient to hold a load at any desired height.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE INVENTION

Figure 1:
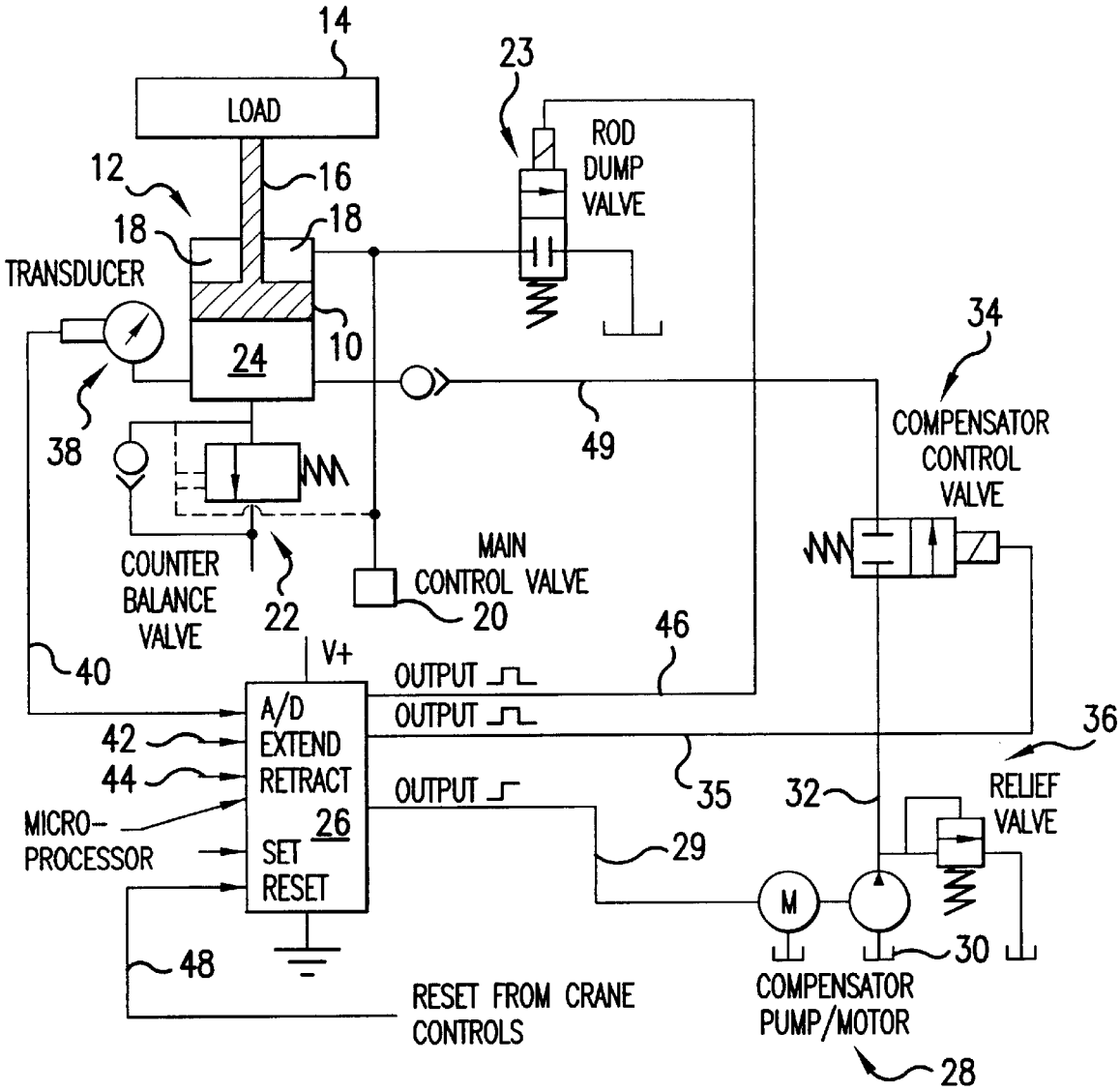
FIG. 1 is a block diagram illustrating the component parts of a control system, in accordance with the present invention.

FIG. 1 illustrates one embodiment of a control system, in accordance with the present invention. The control system controls movement of a piston 10 within a hydraulic cylinder 12, which in turn controls movement of a load 14 connected to a rod 16 of the piston 10.

Primary movement of the piston 10 in one direction may be achieved via any known conventional manner. For example, the piston 10 is moved by activating a main control valve 20 to supply pressurized hydraulic fluid to a piston head-side 24 of the hydraulic cylinder 12. The hydraulic fluid causes the piston 10 to move. Meanwhile, hydraulic fluid leaves the hydraulic cylinder 12, via the main control valve 20, in fluid communication with a piston rod-side 18 of the hydraulic cylinder 12.

Primary movement of the piston 10 in the opposite direction may again be achieved via any known conventional manner. For example, the main control valve 20 directs fluid to enter the piston rod-side 18 of the hydraulic cylinder 12, while a counter balance valve 22 allows hydraulic fluid to leave the piston head-side 24 of the hydraulic cylinder 12.

Now, with reference to FIG. 1, the components associated with the compensation control system to hold the piston's position steady to avoid a "stick slip condition" will be explained. A microprocessor 26 is provided to oversee the control system. Of course, the microprocessor 26 would have associated RAM and ROM memory, either internal or external, to facilitate its operation. A rod dump valve 23 is controlled by an output 46 to relieve the rod-side pressure 18 in the cylinder. This element of the system eliminates the need to compensate for the effects of the rod-side fluid, which would also be cooling.

A compensator pump/motor 28 is controlled by a first output 29 of the microprocessor 26. The compensator pump/motor 28 is operable to draw hydraulic fluid from a common reservoir 30 and deliver the hydraulic fluid, via a first conduit 32, to a valve, such as a compensator control valve 34. A relief valve 36 is also in fluid communication with the first conduit 32 in order to limit the pressure of hydraulic fluid in the first conduit 32.

The compensator control valve 34 is normally in an "off" condition, such that pressurized hydraulic fluid may not pass therethrough. However, the compensator control valve 34 is electrically controlled by a second output 35 of the microprocessor 26. The second output 35 may take the form of an output pulse having a "high" state and a "low" state. The "high" state of the second output 35 causes a solenoid of the compensator control valve 34 to activate an internal valve, so as to place the compensator control valve 34 into an "on" condition. In the "on" condition, the compensator control valve 34 allows hydraulic fluid to flow therethrough.

Hydraulic fluid passing through the compensator control valve 34 travels, via a third conduit 49 into the piston head-side 24 of the hydraulic cylinder 12. Hence, the pressure on the piston head-side 24 of the hydraulic cylinder 12 can be subsidized, when the compensator pump/motor 28 and the compensator control valve 34 are activated by the microprocessor 26.

A transducer 38 is connected to the piston head-side 24 of the hydraulic cylinder 12. The transducer 38 measures a pressure of the hydraulic fluid on the piston head-side 24 of the hydraulic cylinder 12. The measured pressure is transmitted to the microprocessor 26, via a control line 40. The measured pressure is an analog signal, which is converted into a digital signal via an analog to digital (A/D) converter of the microprocessor 26.

Of course, the microprocessor 26, which controls the inventive compensation control system for the piston 10, could also be used to control the conventional primary movement system for the piston 10. For example, the microprocessor 26 could receive first and second inputs 42, 44 to signal that the load is to be extended or retracted, respectively. Further, in addition to output 46, provided to control the rod dump valve 23, similar outputs (not illustrated) could control the other necessary components for primary movement, such as the main control valve 20. As illustrated in FIG. 1, it is also contemplated that the microprocessor 26 would have additional inputs, such as a reset input 48 to receive a reset signal from a user activated control panel.

Figure 2:
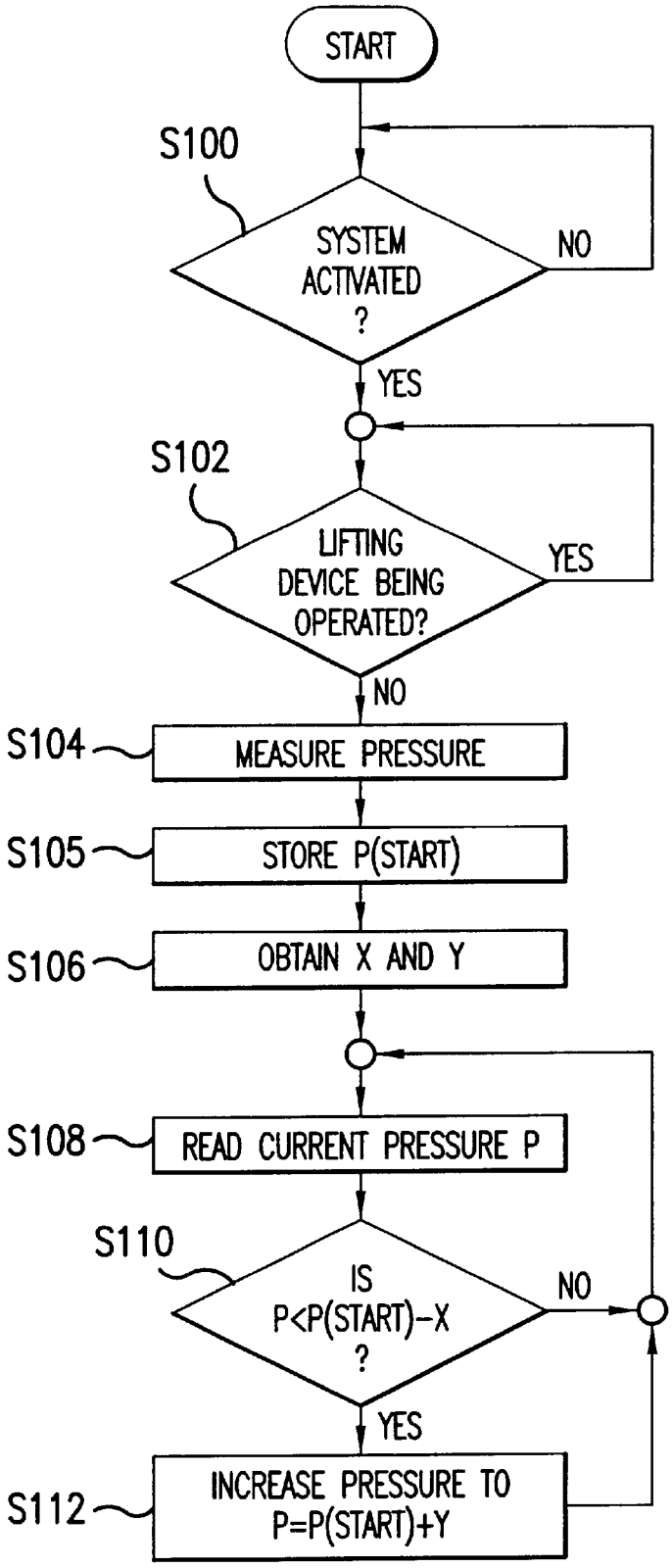
FIG. 2 is a flow chart illustrating a method of operation for the control system of FIG. 1.

Now, with reference to FIG. 2, a flowchart explaining an operational procedure for the present invention will be explained. It is contemplated that a series of self-diagnostic tests or error checks would be performed prior to initiation of the operational procedure to ensure that all of the system's components were fully operational. To this end, lights, gauges, or other indicators would be provided in the operator's area to indicate faults, an activated state, and/or pressures measured during the operational procedure In step S100, it is determined whether or not the compensation control system has been activated. If not, the procedure waits until the compensation control system has been activated. If so, processing proceeds to step S102. Activation of the compensation control system could be accomplished via a switch located in the user's area of the load lifting device.

In step S102, it is ascertained if the lifting device is in operation. For example, it is ascertained if a hoist is being operated, a boom is being extended, retracted, tilted or swiveled, etc. If operation of the lifting device is ongoing, the procedure continues to monitor the operation until the operation stops. Once operation of the lifting device stops, the process continues to step S104.

"Stopping" of the load lifting device may be defined as a lack of operation of the load lifting device for a predetermined time, such as five seconds, or activation of a "stop" switch by a user of the load lifting device. Once the load lifting device is stopped, the main control valve 20 is closed and the rod dump valve 23 is opened.

In step S104, the hydraulic pressure in the hydraulic cylinder 12 is measured, via the transducer 38. Next, in step S105, the measured pressure is stored in a memory as P(start) by the microprocessor 26. In step S106, the microprocessor obtains two values X and Y. The values X and Y relate to changes in the pressure of the hydraulic fluid in the hydraulic cylinder 12, which can occur without causing a stick slip condition to occur, or the load to be lifted, respectively. The value X would be a tolerable drop in psi in the hydraulic cylinder 12, which could occur without the occurrence of a stick slip condition. The value Y would be a tolerable increase in psi in the hydraulic cylinder 12, which could occur without resulting in any lifting of the load.

In step S108, the current pressure P in the hydraulic cylinder 12 is measured using the transducer 38. Next, in step S110, the current pressure P is compared to P(start)−X. If the current pressure P is not less than P(start)−X, the procedure returns to step S108. By this arrangement, the procedure continually monitors the current pressure P in the hydraulic cylinder until the current pressure drops below P(start)−X.

Once the current pressure P drops below P(start)−X, the procedure moves to step S112. In step S112, the pressure in the hydraulic cylinder 12 is increased to P(start)+Y, such as by activation of the compensator pump/motor 28 and the compensator control valve 34.

The pressure P(start)+Y is insufficient to cause movement of the piston 10, and hence lifting of the load 14. The reason why the pressure is increased to a value above P(start) is because the pressure in the hydraulic cylinder 12 will have to be adjusted less frequently, which results in less wear and tear on the associated valves, pumps, and motors. Of course, it would be possible to obtain the benefits of the present invention by simply raising the pressure in the hydraulic cylinder 12 up to only P(start), if so desired. In such an event, Y would equal zero and there would be no need to include or process the variable Y. Also, Y could equal a negative number, which would result in raising the pressure in the hydraulic cylinder 12 up to a value less than P(start). Compensating the pressure to a point below the initial pressure P(start) would also be adequate to prevent motion of the load. Further, compensating the pressure to a point below the initial pressure P(start) could prove to be more certain in preventing unwanted movement of the load.

Once the pressure is raised to P(start)+Y, the procedure returns to step S108. The procedure continues to monitor the pressure in the hydraulic cylinder 12 and to supplement that pressure should it drop below P(start)−X.

In a preferred manner of operation, the step S102, wherein it is ascertained if the lifting device is being operated, would function as an interrupt signal to the microprocessor 26. In other words, if the lifting device is being operated by a user, such as by having its hoist or boom operated, the procedure would stop executing and return to step S100. The interrupt procedure prevents the compensatory hydraulic fluid system from operating at the same time as the primary hydraulic system.

The values X and Y may be fixed numbers based upon the type of components employed in the lifting device. However, more preferably, the values X and Y are variables stored in a look-up table, which is indexed by a P(start) value. Alternatively, the values X and Y could be determined by an equation, having P(start) as a variable. In either event, the values of X and Y will be dependant upon the value of P(start). By this arrangement, the values of X and Y when the load lifting device is holding a heavy load steady will be different from the values of X and Y when the load lifting device is holding a relatively lighter load steady. Further, the values of X and Y could be influenced by the ambient temperature. A typical range of the pressures involved might be: P=500 to 3,000 psi; X=10 to 100 psi; and Y5 to 20 psi.

Of course, if more than one hydraulic cylinder 12 is employed to lift a load 14, one would apply the teachings of the present invention to each hydraulic cylinder supporting the load 14. However, it is envisioned that the microprocessor 26 would be able to control the entire system if multiple hydraulic cylinders 12 were used. Further, it would be possible to use a common compensator pump/motor 28 and a separate compensator control valve 34 for each cylinder to provide compensatory hydraulic fluid to multiple hydraulic cylinders.

Figure 3:
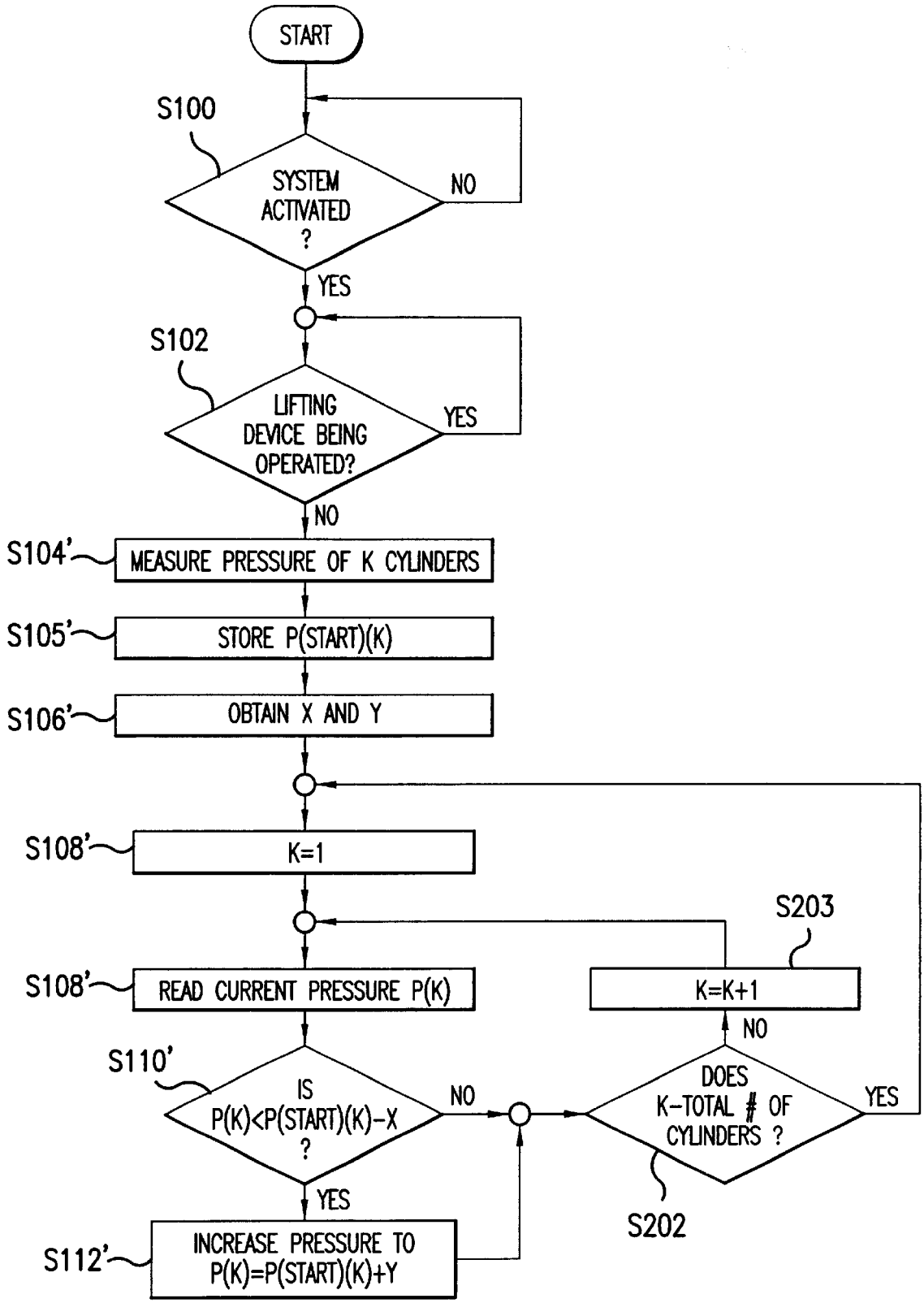
FIG. 3 is a flow chart illustrating a method of operation for the control system when multiple hydraulic cylinders are involved.

FIG. 3 is a flow chart illustrating an operational procedure when plural hydraulic cylinders are employed in the load lifting device. Steps S100 and S102 are identical to the steps described in association with FIG. 2.

In step S104', the pressures P(k) of each hydraulic cylinder used to move the load are measured, where k equals 1, 2, . . . up to the number of the cylinders used. In step S105', the measured starting pressures are stored as P(start)(k) for each of the cylinders, e.g. P(start)(1), P(start)(2), etc.

In step S106', the values X and Y are obtained by the microprocessor 26. The values of X and Y may be the same for each cylinder, or there may be specific X(k) and Y(k) values for each cylinder, particularly if the cylinders are of different types or sizes.

Next, in step S200, a variable k is set equal to 1 (meaning that the first hydraulic cylinder will be analyzed first). In step S108', the current pressure in hydraulic cylinder (k) is measured.

Next, in step S110', the current pressure P(k) is compared to P(start)(k)−X. If P(k) is less then P(start)(k)−X, then the pressure in hydraulic cylinder k is increased to P(start)(k)+Y in step S112'. If P(k) is not less than P(start)(k)−X, the procedures moves to step S202.

In step S202, it is evaluated if k equals the total number of hydraulic cylinders used by the load lifting device to lift the load 14. In other words, has the last cylinder been analyzed? If not, the variable (k) is incremented in step S203, and the next hydraulic cylinder is analyzed by proceeding to step S108'. If the last cylinder has been analyzed, the procedure moves to step S200, where the variable k is reset to equal 1, and the procedure goes back to measure the current pressure in the first hydraulic cylinder.

By the method of FIG. 3, multiple hydraulic cylinders may be monitored and compensatory hydraulic fluid may be applied thereto to prevent a stick slip condition.

Figure 4:
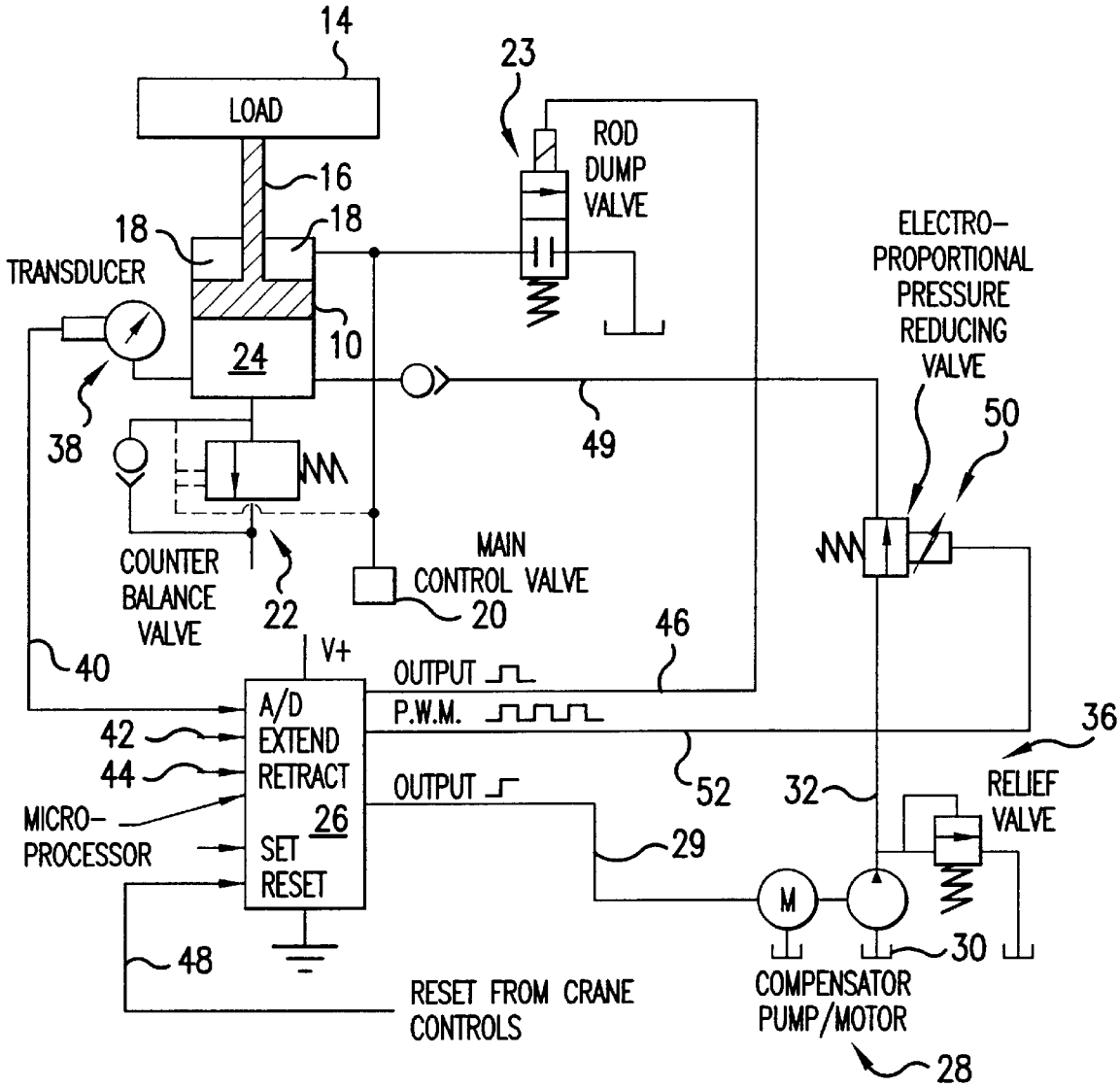
FIG. 4 is a block diagram illustrating the component parts of a control system, in accordance with an alternative embodiment of the present invention.

FIG. 4 is a view illustrating an alternative embodiment for a control system, in accordance with the present invention. Like component parts have been assigned same reference numerals. Basically, the alternative control system employs an electro-proportional pressure reducing valve 50 instead of the compensator control valve 34, described in conjunction with FIG. 1.

The electro-proportional pressure reducing valve 50 receives a control signal 52 from the microprocessor 26. The control signal 52 includes a pulse width modulated signal which controls the electro-proportional pressure reducing valve 50, such that the hydraulic fluid flow therethrough can be controlled. The electro-proportional pressure reducing valve 50 is able to more accurately control the compensatory hydraulic fluid applied to the hydraulic cylinder 12, as compared to the solenoid-driven, compensator control valve 34 of FIG. 1.

The invention being thus described, it will be obvious that the same may be varied in many ways. For example, the outputs and inputs of the microprocessor 26 have been illustrated as hardwired, however wireless signals may be transmitted by and received at the microprocessor 26. Although the illustrated transducer 38 has an analog output, the transducer 38 could be replace by a transducer having a digital output. This would obviate the analog to digital conversion which takes place in the microprocessor 26.

Although the present invention compensates for a pressure change in a hydraulic cylinder 12 by applying compensatory hydraulic fluid, it is envisioned that the pressure could be held constant by controllably changing the volume of the hydraulic cylinder 12. For example, a compensatory piston could be provided on the piston head-side 24 inside the hydraulic cylinder 12, or a bladder, so as to form the circular wall of the piston head-side 24 of the hydraulic cylinder 12. By moving the compensatory piston of the bladder toward the primary piston 10, one could increase the hydraulic pressure on the piston head-side 24, so as to compensate for a loss of hydraulic pressure due to a drop in temperature.

Such variations are not to be regarded as a departure from the spirit and scope of the invention, and all such modifications as would be obvious to one skilled in the art are intended to be included within the scope of the following claims.

We claim:

1. A method of operating a load lifting device to move a load and hold the load steady, said method comprising the steps of:

applying primary hydraulic fluid to one of two sides of a piston in a hydraulic cylinder, thereby moving the piston such that the load is moved to a desired position;

monitoring a hydraulic pressure on one of the two side of the piston; and increasing hydraulic pressure on one of the two sides of the piston, if the monitored hydraulic pressure changes by a predetermined amount.

2. The method of claim 1, wherein said step of increasing the hydraulic pressure includes applying compensatory hydraulic fluid to the hydraulic cylinder.

3. The method of claim 2, wherein the compensatory hydraulic fluid is applied to the side of the piston which has its hydraulic pressure monitored.

4. The method of claim 2, wherein said step of applying compensatory hydraulic fluid includes:

powering a compensator pump to pump hydraulic fluid; and activating a compensator control valve to communicate the pumped hydraulic fluid to the hydraulic cylinder.

5. The method of claim 2, wherein said step of applying compensatory hydraulic fluid includes:

powering a compensator pump to pump hydraulic fluid; and activating an electro-proportional pressure reducing valve to communicate the pumped hydraulic fluid to the hydraulic cylinder.

6. The method of claim 5, wherein said step of activating the electro-proportional pressure reducing valve includes applying a pulse width modulated signal thereto.

7. A method of operating a load lifting device to move a load and hold the load steady, said method comprising the steps of:

sensing that the load lifting device has stopped moving a load;

measuring a first initial hydraulic pressure in a first hydraulic cylinder;

storing the first initial hydraulic pressure as a value in memory;

monitoring the hydraulic pressure in the first hydraulic cylinder; and if the hydraulic pressure in the first hydraulic cylinder drops by a first predetermined value relative to the first initial hydraulic pressure, applying hydraulic fluid to the first hydraulic cylinder to raise the hydraulic pressure to a second predetermined value.

8. The method according to claim 7, wherein the second predetermined value is greater than the first initial hydraulic pressure.

9. The method according to claim 7, wherein the second predetermined value is greater than the first initial hydraulic pressure by approximately 5 to 20 psi.

10. The method according to claim 7, wherein the first predetermined vaue is approximately 10 to 100 psi.

11. The method according to claim 7, further comprising the steps of:

measuring a second initial hydraulic pressure in a second hydraulic cylinder;

monitoring the hydraulic pressure in the second hydraulic cylinder; and if the hydraulic pressure in the second hydraulic cylinder drops by a third predetermined value relative to the second initial hydraulic pressure, applying hydraulic fluid to the second hydraulic cylinder to raise the hydraulic pressure to a fourth predetermined value.

12. A lift control system for a load lifting apparatus comprising:

a hydraulic cylinder having a piston moveably mounted therein;

a primary pump for providing hydraulic fluid to one side of said piston in said hydraulic cylinder to cause said piston to move;

a main control value to control the flow of hydraulic fluid from said primary pump to said hydraulic cylinder;

a compensator pump for providing hydraulic fluid to one side of said piston in said hydraulic cylinder;

a compensator control valve to control the flow of hydraulic fluid from said compensator pump to said hydraulic cylinder;

a transducer connected to said hydraulic cylinder to measure a hydraulic pressure therein; and a controller communicatively connected to said compensator control valve and said transducer, wherein said controller causes compensatory hydraulic fluid to be supplied to said hydraulic cylinder to maintain an approximately constant hydraulic pressure in said hydraulic cylinder in order to prevent movement of a load when the load lifting apparatus has positioned the load at a desired height.

13. The apparatus according to claim 12, wherein said compensator pump provides hydraulic fluid to a side of said piston which is a same side of said piston to which said primary pump provides hydraulic fluid.

14. The apparatus according to claim 12, wherein said primary pump and said compensator pump are a common pump assembly.

15. The apparatus according to claim 12, wherein said primary pump provides hydraulic fluid to a piston head-side of said piston in said hydraulic cylinder to cause said piston to move in a first direction, said apparatus further comprising:

a rod dump valve in fluid communication with a piston rod-side of said piston in said hydraulic cylinder to allow hydraulic fluid to leave said hydraulic cylinder.

16. The apparatus according to claim 15, further comprising:

a counter balance valve in fluid communication with said piston head-side of said piston in said hydraulic cylinder.

17. The apparatus according to claim 16, wherein said controller is communicatively connected to, and controls, said primary pump, said main control valve; said compensator pump, said compensator control valve, said rod dump valve, and said counter balance valve.

18. The apparatus according to claim 12, wherein said controller is a microprocessor.

19. The apparatus according to claim 12, wherein said compensator control valve is an electro-proportional pressure reducing valve.

20. The apparatus according to claim 19, wherein said electro-proportional pressure reducing valve is controlled by a pulse width modulated signal supplied by said controller.

* * * * *